US010018444B1

(12) United States Patent
Nielson

(10) Patent No.: US 10,018,444 B1
(45) Date of Patent: Jul. 10, 2018

(54) BOW HOLDER APPARATUS

(71) Applicant: John Brian Nielson, Blaine, MN (US)

(72) Inventor: John Brian Nielson, Blaine, MN (US)

( * ) Notice: Subject to any disclaimer, the term of this patent is extended or adjusted under 35 U.S.C. 154(b) by 0 days.

(21) Appl. No.: 15/481,963

(22) Filed: Apr. 7, 2017

Related U.S. Application Data

(60) Provisional application No. 62/476,897, filed on Mar. 27, 2017.

(51) Int. Cl.
*F41B 5/14* (2006.01)
*B63B 17/00* (2006.01)

(52) U.S. Cl.
CPC ..... *F41B 5/1453* (2013.01); *B63B 17/00* (2013.01); *B63B 2710/00* (2013.01)

(58) Field of Classification Search
CPC ..... F41B 5/1453; F41B 5/14; F41B 5/1449; B63B 17/00; B63B 2710/00; B60R 9/08; B60R 9/06; B60R 7/14
See application file for complete search history.

(56) References Cited

U.S. PATENT DOCUMENTS

| | | | | |
|---|---|---|---|---|
| 5,595,333 | A * | 1/1997 | Boston | B60R 7/14 211/60.1 |
| 5,641,106 | A * | 6/1997 | Slaughter | B60R 9/06 224/324 |
| 5,791,610 | A * | 8/1998 | Sanchez | F41B 5/14 224/916 |
| 6,968,834 | B1 * | 11/2005 | Gibbs | F41B 5/1449 124/1 |
| 7,559,444 | B1 * | 7/2009 | Church | B60R 7/14 224/401 |
| 2003/0094471 | A1 * | 5/2003 | McNalley | B60R 7/14 224/403 |
| 2011/0162631 | A1 * | 7/2011 | Tulpa | F41B 5/1449 124/86 |

* cited by examiner

*Primary Examiner* — Corey Skurdal
(74) *Attorney, Agent, or Firm* — Dave Alan Lingbeck

(57) ABSTRACT

A bow holder apparatus for supporting a bow and making the bow readily available for immediate use. The bow holder apparatus includes a support assembly including a bar having a main portion and opposed end portions; and a clamping assembly including a pair of levers pivotably coupled to the bar and engagably biased with the end portions of the bar.

12 Claims, 4 Drawing Sheets

BOW HOLDER APPARATUS

CROSS-REFERENCE TO RELATED APPLICATIONS

The present application claims priority to the provisional application Ser. No. 62/476,897 filed on Mar. 27, 2017, the disclosure of which is expressly incorporated by reference herein in its entirety.

BACKGROUND OF THE INVENTION

Field of the Invention

The present invention relates to racks and more particularly pertains to a bow holder apparatus for supporting a bow and making the bow readily available for immediate use.

Description of the Prior Art

The use of racks is known in the prior art. More specifically, racks heretofore devised and utilized are known to consist basically of familiar, expected and obvious structural configurations, notwithstanding the myriad of designs encompassed by the crowded prior art which have been developed for the fulfillment of countless objectives and requirements.

The prior art includes a system and associated methods which may be used to adjustably secure to an all terrain or other vehicle for transport hunting, fishing, and utility equipment, and the like are presented. Another prior art includes an ATV mounted rack including a pair of rotatable U-shaped uprights biased toward a first position. Upon manual pivotal movement of a handle interconnected with the uprights through linkages, the handle will cause the shaped uprights to rotate toward a second position for receiving or releasing a hunting bow, rifle, shotgun or other equipment. Also, another prior art includes a bowholder for supporting an archery bow on a fixed or movable structure, and particularly adapted for supporting an archery bow on a cargo carrier rack or the like of a motor vehicle, such as an all terrain vehicle, includes an elongated tubular frame member supported on spaced-apart support blocks which are mountable on a cargo carrier rack by releasable fastener assemblies. While these devices fulfill their respective, particular objectives and requirements, the aforementioned patents do not disclose a new bow holder apparatus.

SUMMARY OF THE INVENTION

The general purpose of the present invention, which will be described subsequently in greater detail, is to provide a bow holder apparatus which has many of the advantages of the racks mentioned heretofore and many novel features that result in a bow holder apparatus which is not anticipated, rendered obvious, suggested, or even implied by any of the prior art racks, either alone or in any combination thereof. The present invention includes a support assembly including a bar having a main portion and opposed end portions; and a clamping assembly including, a pair of levers pivotably coupled to the bar and engagably biased with the end portions of the bar. None of the prior art includes the combination of the elements of the present invention.

There has thus been outlined, rather broadly, the more important features of the bow holder apparatus in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a bow holder apparatus which has many of the advantages of the racks mentioned heretofore and many novel features that result in a bow holder apparatus which is not anticipated, rendered obvious, suggested, or even implied by any of the prior art racks, either alone or in any combination thereof.

Still another object of the present invention is to provide a bow holder apparatus for supporting a bow and making the bow readily available for immediate use.

Still yet another object of the present invention is to provide a bow holder apparatus that safeguards the bow while boating in particular.

Even still another object of the present invention is to provide a bow holder apparatus that can be easily and quickly mounted to a vehicle in particular to a boat.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a perspective view of the present invention mounted to a railing of a boat or the like.

DETAILED DESCRIPTION OF THE INVENTION

Figure 1:
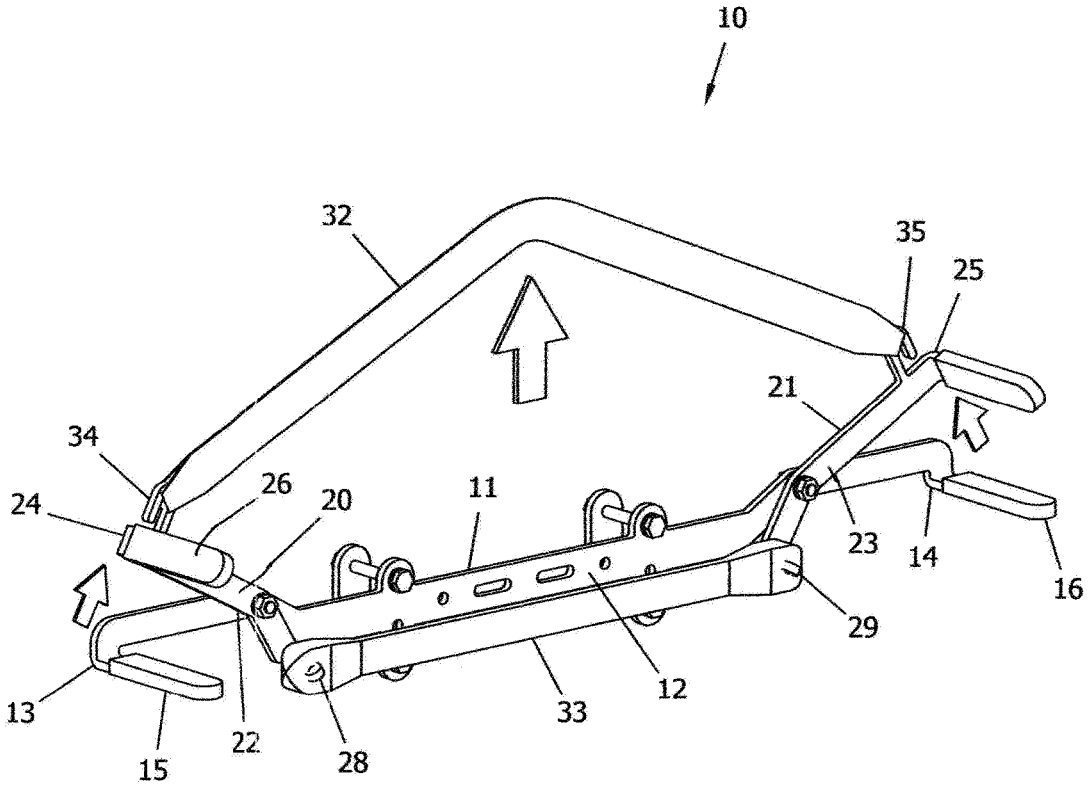
FIG. 1 is a perspective view of a bow holder apparatus according to the present invention.
Figure 2:
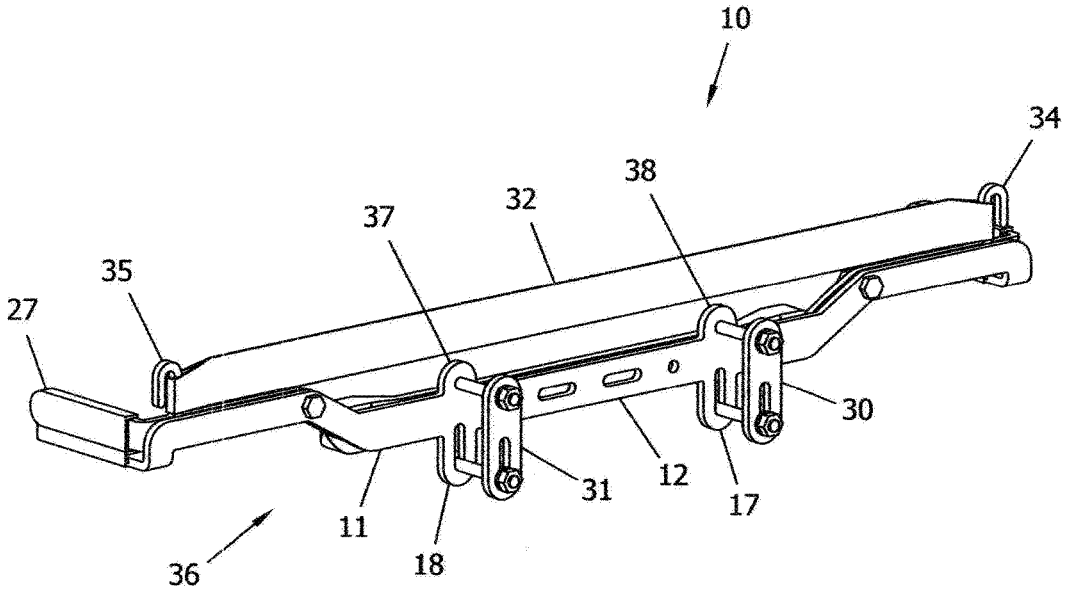
FIG. 2 is another perspective view of the present invention.
Figure 3:
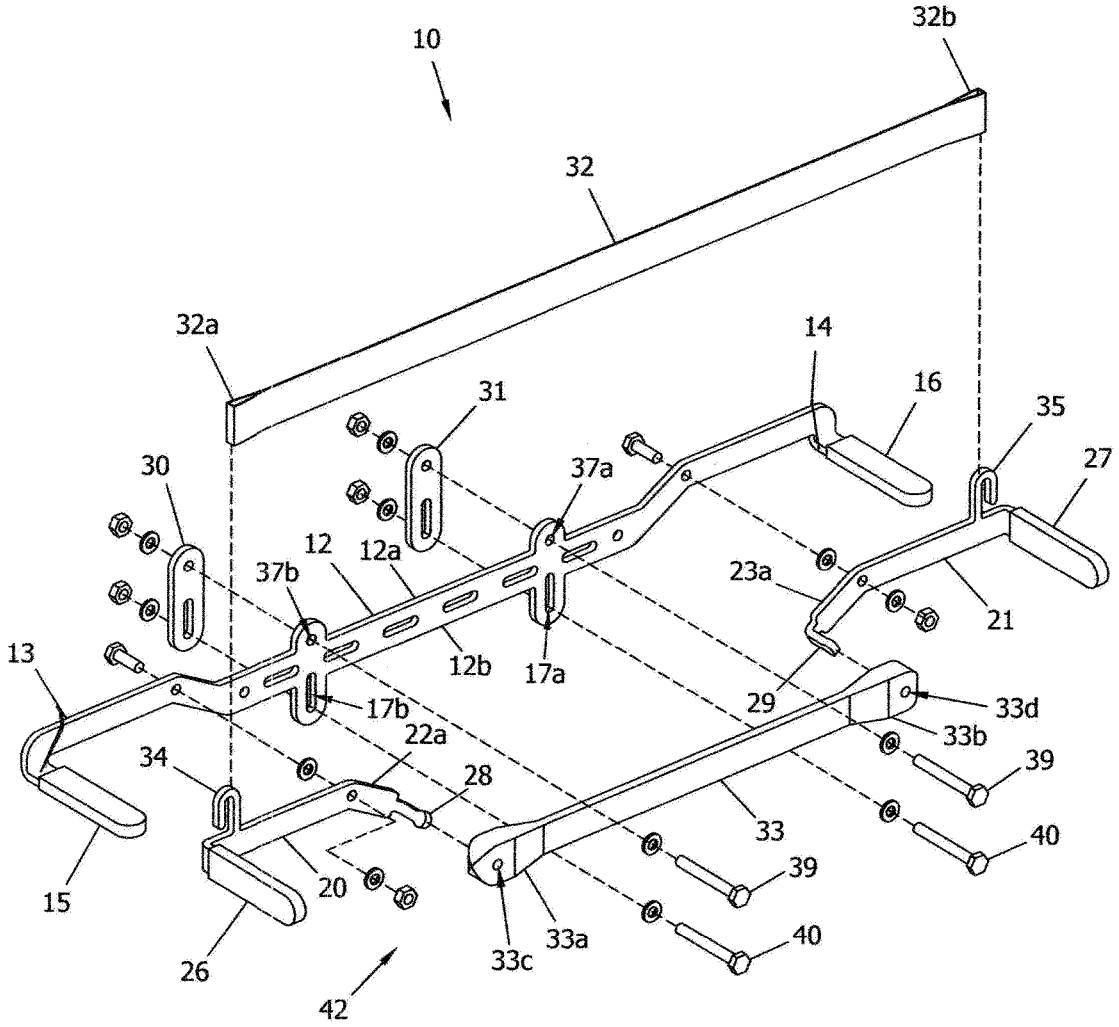
FIG. 3 is an exploded perspective view of the present invention.
Figure 4:
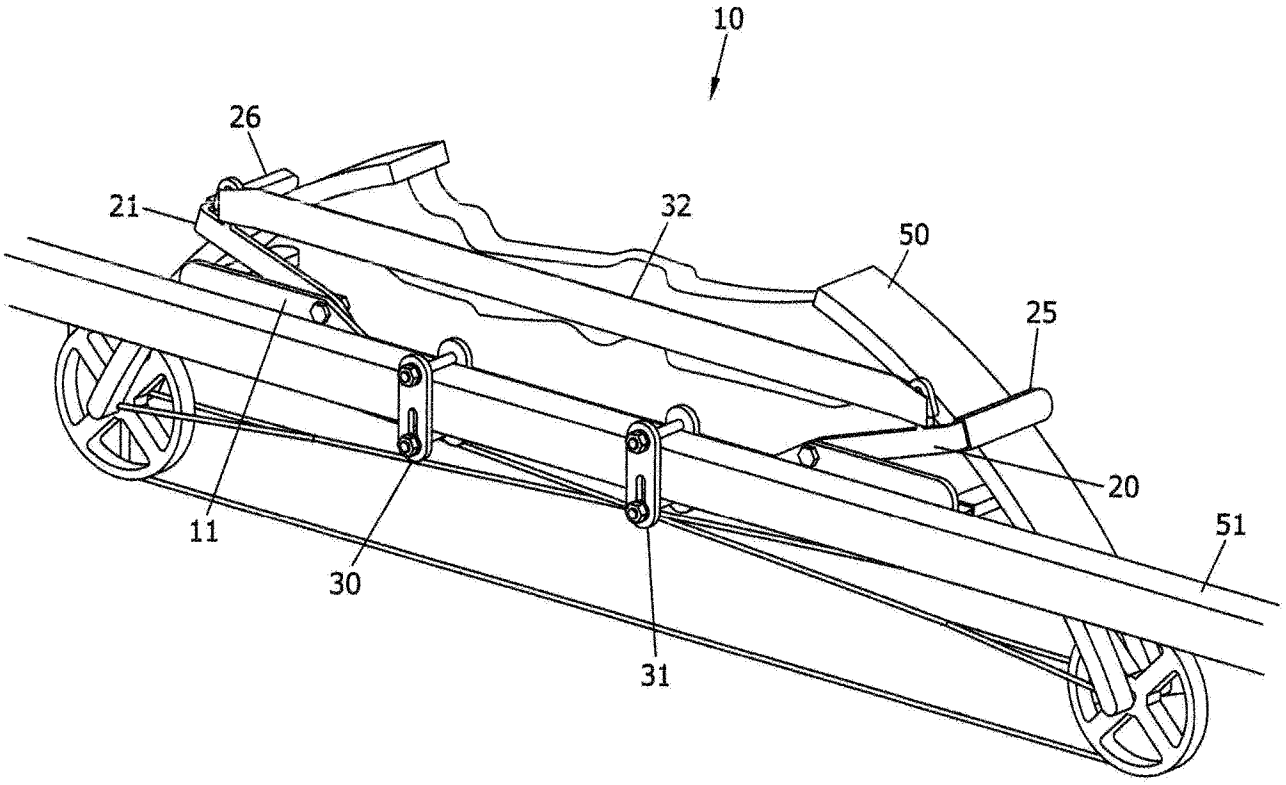

With reference now to the drawings, and in particular to FIGS. 1 through 4 thereof, a bow holder apparatus embodying the principles and concepts of the present invention and generally designated by the reference numeral 10 will be described.

As best illustrated in FIGS. 1 through 4, the bow holder apparatus 10 comprises a support assembly 36 including a bar 11 having a main portion 12 and opposed end portions 13, 14; and a clamping assembly 42 including a pair of levers 20, 21 pivotably and conventionally coupled to the bar 11 and engagably biased with the end portions 13, 14 of the bar 11.

The end portions 13, 14 of the bar 11 are angled substantially perpendicular to the main portion 12 of the bar 11. The support assembly 36 also includes first padded sleeves 15, 16 each conventionally disposed about a respective end portion 13, 14 of the bar 11 to protect a bow 50. The main portion 12 of the bar 11 has first and second longitudinal edges 12*a*, 12*b*. The support assembly 36 further includes first support extensions 37, 38 spaced apart and integrally connected to the main portion 12 of the bar 11 and extending upwardly from the first longitudinal edge 12*a* of the main portion 12 of the bar 11 and each having an opening 37*a*, 38*a* disposed therethrough for receiving a first fastener 39. The support assembly 36 also includes second support extensions 17, 18 spaced apart and integrally connected to the main portion 12 of the bar 11 and extending downwardly from the second longitudinal edge 12*b* of the main portion 12 of the bar 11 and each having an elongated slot 17*a*, 18*a* disposed therethrough for receiving a second fastener 40. Each of the second support extensions 17, 18 is aligned with a respective first support extension 37, 38. The elongated slots 17*a*, 18*a* extend perpendicular to the bar 11. The support assembly 36 further includes brackets 30, 31 used in cooperation with the first and second support extensions 17, 18, 37, 38 to mount the bar 11 to various sized railings 51 on a boat or the like with the second fasteners 40 being adjustably disposed through the elongated slots 17*a*, 18*a* of the second support extensions 17, 18.

Each of the levers 20, 21 has a main portion 22, 23 conventionally and pivotably coupled to the bar 11 and has an end portion 24, 25 disposed proximate to and movable towards and away from a respective end portion 13, 14 of the bar 11 to hold and clamp the bow 50 between the end portions 13, 14, 24, 25 of the bar 11 and the lever 20, 21. The levers 20, 21 are conventionally and pivotably coupled to the bar 11 intermediate of the main portions 22, 23 of the levers 20, 21. The end portion 24, 25 of each of the levers 20, 21 is angled substantially perpendicular to the main portion 22, 23 of the respective lever 20, 21 and disposed parallel to the respective end portion 13, 14 of the bar 11. The clamping assembly 42 also includes second padded sleeves 26, 27 conventionally disposed about the end portions 24, 25 of the levers 20, 21 to protect the bow 50. The clamping assembly 42 further includes hooks 34, 35 each integrally connected to and extending outwardly from the main portion 22, 23 of a respective lever 20, 21 and proximate to the end portion 24, 25 of the respective lever 20, 21. The clamping assembly 42 further includes a strap 32 having looped ends 32*a*, 32*b* which are removably disposed about the hooks 34, 35 to pivot the levers 20, 21 relative to the bar 11 and move the end portions 24, 25 of the levers 20, 21 away from the end portions 13, 14 of the bar 11. The main portion 22, 23 of each lever 20, 21 has an end 22*a*, 23*a* opposed to the end portion 24, 25 of the respective lever 20, 21. The clamping assembly 42 includes pins 28, 29 each integrally connected to and extending outwardly from and proximate to the end 22*a*, 23*a* of the main portion 22, 23 of a respective lever 20, 21. The clamping assembly 42 also includes an elongated biased member 33 having ends 33*a*, 33*b* and holes 33*c*, 33*d* disposed laterally through the elongated biased member 33 near the ends 33*a*, 33*b*. The pins 28, 29 are removably received in the holes 33*c*, 33*d* of the elongated biased member 33 with the elongated biased member 33 pivoting the levers 20, 21 relative to the bar 11 and biasedly moving the end portions 24, 25 of the levers 20, 21 towards the end portions 13, 14 of the bar 11.

In use, the user clamps the bow holder apparatus 10 about a railing 51 of a boat 50 using the first and second support extensions 17, 18, 37, 38, the brackets 30, 31 and the first and second fasteners 39, 40 with the end portions 13, 14, 24, 25 of the bar 11 and levers 20, 21 disposed horizontally. The user moves the strap 32 away from the bar 11 which pivots the end portions 24, 25 of the levers 20, 21 away from the end portions 13, 14 of the bar 11 to secure the bow 51 upon the bow holder apparatus 10 between the end portions 13, 14, 24, 25 of the bar 11 and the levers 20, 21 and the user releases the strap 32 with the elongated biased member 33 biasedly pivoting the end portions 24, 25 of the levers 20, 21 towards the end portions 13, 14 of the bar 11 to hold the bow 51 upon the bow holder apparatus 10. To remove the bow 51 from the bow holder apparatus 10, the user moves the strap 32 to pivot the end portions 24, 25 of the levers 20, 21 away from the end portions 13, 14 of the bar 11.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the bow holder apparatus. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bow holder apparatus comprising:

a support assembly including a bar having a main portion and opposed end portions, wherein the main portion of the bar has first and second longitudinal edges, wherein the support assembly further includes first support extensions spaced apart and integrally connected to the main portion of the bar and extending upwardly from the first longitudinal edge of the main portion and each having an opening disposed therethrough for receiving a first fastener; and a clamping assembly including a pair of levers pivotably coupled to the bar and engagably biased with the end portions of the bar, wherein the support assembly also includes second support extensions spaced apart and integrally connected to the main portion of the bar and extending downwardly from the second longitudinal edge of the main portion and each having an elongated slot disposed therethrough for receiving a second fastener.

2. The bow holder apparatus as described in claim 1, wherein each of the second support extensions is aligned with a respective said first support extension, wherein the elongated slots extend perpendicular to the bar.

3. The bow holder apparatus as described in claim 1, wherein the support assembly further includes brackets used in cooperation with the first and second support extensions to mount the bar to various sized railings on a boat or the like with the second fasteners being adjustably disposed through the elongated slots of the second support extensions.

4. A bow holder apparatus comprising:

a support assembly including a bar having a main portion and opposed end portions, wherein the end portions of the bar are angled substantially perpendicular to the main portion of the bar; and a clamping assembly including a pair of levers pivotably coupled to the bar and engagably biased with the end portions of the bar, wherein each of the levers has a main portion pivotably coupled to the bar and has an end portion disposed proximate to and movable towards and away from a respective end portion of the bar to hold and clamp the bow between the end portions of the bar and the lever.

5. The bow holder apparatus as described in claim 4, wherein the levers are coupled to the bar intermediate of the main portions of the levers.

6. The bow holder apparatus as described in claim 4, wherein the end portion of each of the levers is angled substantially perpendicular with the main portion of the lever and disposed parallel to a respective said end portion of the bar.

7. The bow holder apparatus as described in claim 4, wherein the clamping assembly also includes second padded sleeves disposed about the end portions of the levers to protect the bow.

8. The bow holder apparatus as described in claim 4, wherein the clamping assembly further includes hooks each integrally connected to and extending outwardly from the main portion of a respective said lever and proximate to the end portion of the respective lever.

9. The bow holder apparatus as described in claim 8, wherein the clamping assembly further includes a strap having looped ends which are removably disposed about the hooks to pivot the levers relative to the bar and move the end portions of the levers away from the end portions of the bar.

10. The bow holder apparatus as described in claim 4, wherein the main portion of each of the levers has an end opposed to the end portion of the respective lever, wherein the clamping assembly includes pins each integrally connected to and extending outwardly from and proximate to the end of the main portion of a respective said lever.

11. The bow holder apparatus as described in claim 10, wherein the clamping assembly also includes an elongated biased member having ends and holes disposed laterally through the elongated biased member near the ends, wherein the pins are removably received in the holes of the elongated biased member with, the elongated biased member pivoting the levers relative to the bar and biasedly moving the end portions of the levers towards the end portions of the bar.

12. A method of using a bow holder apparatus comprising:

providing a bar having end portions, a pair of levers pivotably coupled to the bar and having end portions, a strap in operable communication with the levers, and an elongated biased member in operable communication with the lever;

mounting the bar to a support;

pivoting the end portions of the levers away from the end portions of the bar by moving the strap away from the bar;

positioning a bow between the end portions of the levers and the bar; and releasing the strap with the elongated biased member pivoting the ends portions of the levers towards the end portions of the bar and, engaging the bow between the end portions of the levers and the bar.

* * * * *